United States Patent [19]

Pol

[11] Patent Number: 4,716,872

[45] Date of Patent: Jan. 5, 1988

[54] ECONOMIC SPEED INDICATOR

[76] Inventor: Alexander T. Pol, 5801 SW. 47 St., Miami, Fla. 33155

[21] Appl. No.: 776,872

[22] Filed: Sep. 17, 1985

[51] Int. Cl.[4] ..... F02D 41/14

[52] U.S. Cl. ..... 123/352; 123/436; 74/861; 73/113; 180/176

[58] Field of Search ..... 123/350, 352, 436; 74/861, 866; 73/113, 114; 180/176, 179; 364/442

[56] References Cited

U.S. PATENT DOCUMENTS

| | | | |
|---|---|---|---|
| 4,023,442 | 5/1977 | Woods et al. | 74/861 |
| 4,047,507 | 9/1977 | Noguchi et al. | 123/352 |
| 4,368,707 | 1/1983 | Leshner et al. | 123/436 |
| 4,393,845 | 7/1983 | Seitz | 123/352 |
| 4,411,174 | 10/1983 | Yokoi et al. | 74/861 |
| 4,445,329 | 5/1984 | Drisko | 74/861 |
| 4,475,506 | 10/1984 | Riordan | 123/352 |
| 4,492,112 | 1/1985 | Igarashi et al. | 73/114 |
| 4,516,652 | 5/1985 | Tanigawa et al. | 74/866 |

FOREIGN PATENT DOCUMENTS

| | | | |
|---|---|---|---|
| 56-75934 | 6/1981 | Japan | 123/350 |
| 58-122338 | 7/1983 | Japan | 123/352 |

*Primary Examiner*—Andrew M. Dolinar

[57] ABSTRACT

A method of finding and device for indicating and holding the economic speed of engines and vehicles, wherein the ratio of fuel consumption to engine torque or vehicle speed is continuously monitored based on the amplitude of impulses of such ratio, value and sign of the derivative of said ratio impulses, and wherein the point of maximum of the economic speed is used to control geared and travelling speed of the vehicle.

7 Claims, 3 Drawing Figures

ECONOMIC SPEED INDICATOR

BACKGROUND OF THE INVENTION

1. Field of the Invention

The invention relates to devices displaying and holding the speed of the vehicle and relating this speed to the fuel consumption; in particular the described invention concerns a method and device for measuring and holding the economic speed of the engine and vehicle.

2. State of the Prior Art

There are described in the patent literature, and are in use numerous, recently predominantly computerized devices, measuring fuel consumption and cruise control arrangements holding the road speed of the vehicle. The instantaneous and/or average fuel consumption per mile is measured (e.g. U.S. Pat. Nos. 4,205,376; 4,205,377; 4,403,584; 4,437,445) with additionally calculated information such as range of fuel consumption, remaining fuel in the tank etc.

The devices of cruise control (e.g. U.S. Pat. Nos. 4,138,723; 4,196,787; 4,453,517; 4,505,357; 4,516,652; 4,519,469) are set by the driver on desired speed of the vehicle. However, both types of devices are not directly related to the economic speed of the vehicle. Therefore, up to date there is no such instrument which unequivocally and universally relates the speed of the vehicle to fuel consumption by indicating and holding the economic speed of the vehicle.

Instantaneous speed and fuel consumption of the vehicle are influenced among others by load, road and weather conditions. Knowing an instant, average and range of fuel consumption does not mean that driver is actually able to use such devices in order to drive a vehicle at the economic speed.

Non-linear characteristics of the engine performance such as brake horsepower, torque and specific fuel consumption versus engine speed undergo changes depending the load and road conditions, but their shape remains the same. Therefore, to use the economic speed of the engine and vehicle means to follow at least one of these characteristics and hold the actual speed around the extreme point of such characteristics. The point and range of the economic speed of the engine and vehicle should be used to find automatically the economic speed: both geared speed and travelling velocity of the vehicle.

From the fuel consumption curve is evident that for a particular point on the operating range of the engine performance, the fuel consumption is minimum and the power developed by the engine is maximum. For continous operation, the selection of the economic operating speed results in large savings in fuel, maintainance and repair costs.

The major engine builders have developed a new "high torque concept", which provides increased performance and better fuel economy. It is also known that in order to execute a smooth gear shift and pick up sufficient power to accelerate the vehicle, the rpm must not fall below the maximum torque range.

Therefore, the method of estimation of the point of the econmic speed of the engine and vehicle is based upon constant finding the function of fuel consumption F to the torque T $$f_t=F/T,$$

or the function of fuel consumption to the vehicle velocity V $$f_v=F/V$$

with subsequent time-quantization and differentiation. The derivative of the quantitized impulses of such ratio Q versus engine speed gives a respective function $$f=dQ/dt,$$

which is further tested for estimation of the sign of the derivative and checking the point of its change in order to find the point of minimum of the function, i.e. the point of maximum of the economic speed.

The invention has three objects:

- to find a point of the point and range of the economic speed and to monitor any deviations from it during operation of the engine and vehicle;
- to couple the point of maximum of the economic speed with the optimal moment for switching the gears, and
- to use this point for control and holding the economic speed of the engine and vehicle.

The above will be apparent from the description of the prefered embodiment accompanied by the following drawings.

BRIEF DESCRIPTION OF THE DRAWINGS

FIG. 1*a*: brake horsepower (1), torque (2), specific brake fuel consumption (3) and quotient of division specific fuel consumption by torque (4).

FIG. 1*b*: the quotient of the fuel consumption/torque and its derivative versus engine speed (and time). Quantitized values of the quotient and respective values of the derivative (arrows) of negative and positive sign around zero value of the derivative.

SUMMARY OF THE INVENTION

Figure 1B:
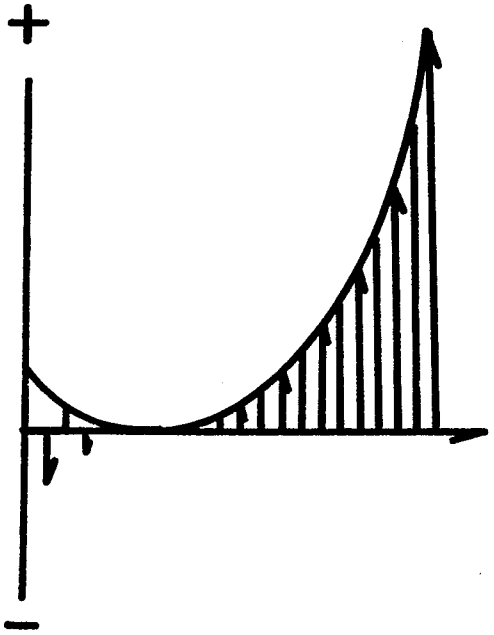
FIGS. 1*a* and 1*b* show characteristics of the engine performance versus engine speed.
Figure 1A:
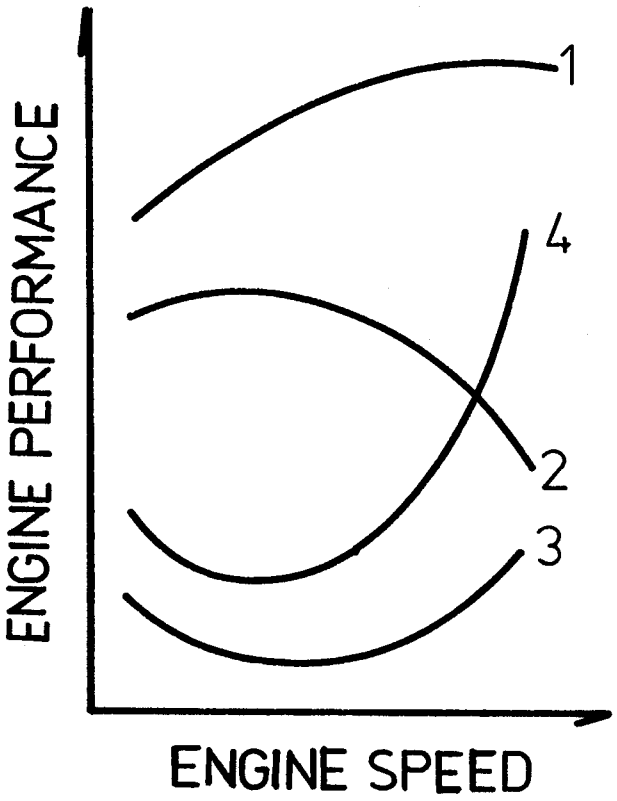

The method of estimation and monitoring of the economic speed of the engine and vehicle is based on finding the extreme point of the relation: specific fuel consumption/torque or velocity of the vehicle. FIG. 1 illustrates the principle of the method of finding the current economic speed of the vehicle according to the described method. The following engine performance curves: brake horsepower (1) torque (2), specific brake fuel consumption (3) and quotient of fuel consumption/torque (4) versus engine speed are presented on FIG. 1*b*. Because extreme character of these curves, also the resultant curve of said quotient has always a point of minimum. This point serves as an indicator of the economic speed of the engine and vehicle. This point and the range of the economic speed is detected by derivation of the time-quantitized actual ratio of the above mentioned quotient. Zero value of the derivative of this quotient and change of its sign indicates the moment when the minimum value of the quotient: fuel consumption/engine performance is reached. As the speed varies above and below the economic one, the sign of the derivative of said ratio indicates whether an actual speed is below (negative) or above (positive) the economic speed point.

Figure 2:
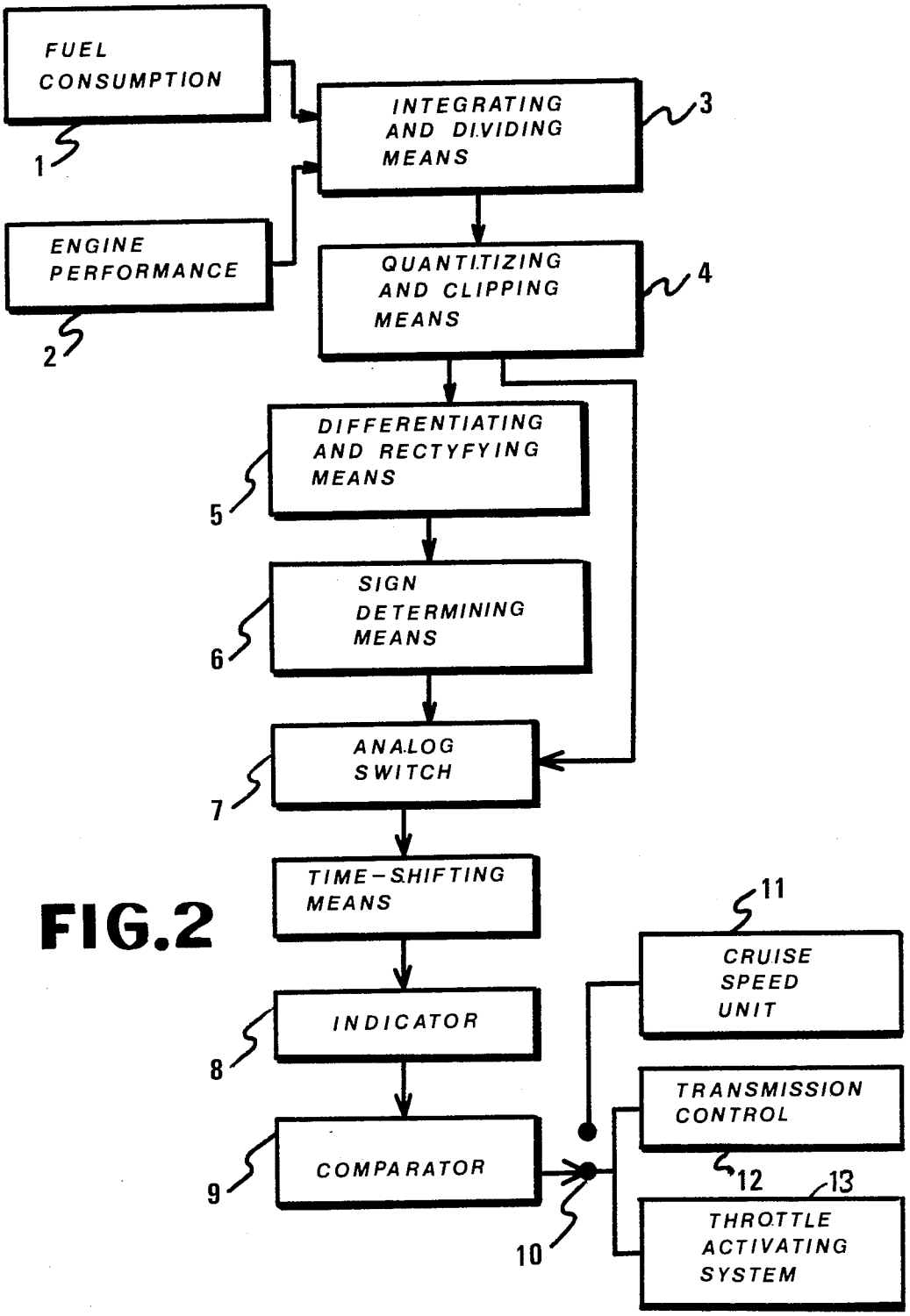
FIG. 2 shows a schematic arrangement of electronic means for finding and holding the economic speed of the engine and vehicle.

The operation of finding the derivative of said ratio and its sign is realized electronically according to the description of an example of the prefered embodiment of the invention, accompanied by the drawings on FIG. 2.

DESCRIPTION OF THE PREFERRED EMBODIMENT

The described embodiment consists of two parts: first one processing the operation of finding the economic speed, and the second one holding the economic speed of the engine and vehicle. The first part comprises: fuel consumption transducer 1, engine or vehicle performance sensor 2(torque or speed of the vehicle), impulse forming and integrating units and unit dividing signals of fuel consumption by signals of a chosen engine performance indicator 3, quantitizing and clipping unit 4, differentiating and rectifying unit 5, sign determining unit of the derivative 6, an analog switch 7, unit for time-shifting and analog or digital indicator 8 of the economic speed.

The second part of the arrangement comprises: comparator 9, switch 10, constant cruise speed unit 11, gear switching or automatic transmission control box 12, and throttle activating system 13.

The described device works as follows: A fuel consumption rate transducer 1 produces an output electric signals proportional to instantaneous fuel consumption rate F, and and the engine performance or vehicle speed sensor 2 reflects the actual performance of the engine T. These signals, after being shaped and integrated are subjected to division in the unit 3: fuel consumption rate/torque or speed of the vehicle. Then, in the unit 4, the value of this quotient undergoes quantization and clipping. The output impulses are subjected to differentiation in the unit 5, and the sign of the derivative is estimated in the comparator 6, which in turn activates the analog switch 7, passing positive or negative polarity impulses. The amplitude of these impulses directly deflects a pointer of the analog indicator 8 monitoring the current speed of the engine and vehicle, and the degree of deviation from the point of maximum of the economic speed. Instead of, or additionally, the analog indicator, a digital one may be used displaying the point of the economic speed or deviation from it. This function may be performed by any kind of digital voltmeter.

The control of gear switching and holding the economic speed or constant cruise speed is realized as follows:

Output signals from the analog indicator 8, passing comparator 9, activate, depending the position of the switch 10, the constant speed cruise control device 11, or gear switch 12 and throttle 13 controlling and holding the economic speed of the vehicle.

Such signals are used to control the gear switching and throttle performance. According to the Specification, signals controlling the gear switching an throttle performance, are delivered from the described economic speed indicator when the amplitude of the derivative of the quantitized impulses approaches null activating such means as comparator or similar electronic devices to control the gear switching and throttle performance in a similar way as it has been described in the art (e.g. U.S. Pat. Nos. 4,138,723; 4,196,787; 4,516,652; 4,519,469). The manner of the control operation is apparent for a person ordinary skilled in electronic control.

The control of the gear transmission is accomplished always when the amplitude of impulses obtained by division of electric signals proportional to fuel consumption rate by electric signals proportional to the torque or vehicle speed and their derivative approaches null regardless of conditions of engine exploitation.

The process of differentiation of the quantitized fuel/engine performance data and sign estimation of the derivative, of course, may also be realized by other electronic means, e.g. by apprioprate microprocessor or microcomputer providing an operation of storage, subtraction, derivation, zero detection and sign estimation of the derivative.

The operation of analog division of the engine performance data may be realized, for instance by means of 4200NB Motorola integrated circuit.

If it is necessary, because of a given engine performance, a separate time-shifting unit may be situated between an analog switch and the economic speed indicator.

The point of maximum torque can be realized by using a vacuum sensor (e.g. U.S. Pat. Nos. 4,428,342; 4,448,162; 4,467,765). It is known that at a given engine speed, the pressure in the intact manifold is related to the advance angle and engine torque in such a way that torque has a maximum value versus advance angle of ignition timing.

This method has been known in the state of art rather long ago. The recent solutions of finding the maximum torque (e.g. U.S. Pat. Nos. 4,173,265; 4,365,601; 4,448,275) are based on signals delivered by the torque convertor sensor.

Therefore, only practical requirements would determine the particular solution of applied mode of operation of measuring the engine performance data according to the described method of finding and holding the economic speed of the engine and vehicle.

What is claimed is:

1. A method of finding and holding the most economical speed of an engine or vehicle, comprising the steps of:

continuously monitoring the ratio of instantaneous fuel consumption rate to engine torque or vehicle speed;

generating impulses in accordance with said ratio;

obtaining a derivative of said impulses;

determining the point of the most economic speed based on the value of said impulses; and controlling the speed of the engine or vehicle according to the determined point of the most economic speed.

2. A device for finding and holding the most economical speed of an engine or vehicle, comprising:

means for continuously monitoring the ratio of instantaneous fuel consumption rate to engine torque or vehicle speed;

means for generating impulses in accordance with said ratio;

means for obtaining a derivative of said impulses;

means for determining the point of the most economic speed based on the value of said impulses; and means for controlling the speed of the engine or vehicle according to the determined point of the most economic speed.

3. A device to claim 2 wherein:

said means for continuously monitoring of said ratio includes fuel consumption and engine or vehicle performance transducers and electronic means for impulse forming and means for performing integration of respective signals from said transducers and division of the integrated values;

said means for generating quantitized impulses of the quotient of said integrated values; and said means for determining the point of the most economic speed include means for determining the sign of said derivative, an analog switch and an analog or digital indicator.

4. A device according to claim 2 further comprising a microprocessor or microcomputer.

5. A device according to claim 2 wherein said means for determining the point of the most economic speed comprises analog switch means for passing positive or negative polarity impulses in accordance with said sign of said derivative and an analog or digital speed indicator activated by said positive and negative polarity impulses.

6. A device according to claim 2 wherein said means for determining the point of the most economic speed includes an electronic unit for time-shifting the control operation thereof.

7. A device according to claim 2 wherein means for control of the gear switching and throttle performance by said signals from said economic speed indicator determine the moment of gear switching and throttle performance.

when the amplitude of said derivative of said quantitized impulses approaches null activating such means as comparator or similar electronic devices.

* * * * *